US005287716A

United States Patent [19]

Szulc

[11] Patent Number: 5,287,716

[45] Date of Patent: Feb. 22, 1994

[54] METHOD OF FORMING CABLE-GUIDING OPENING IN METAL WALL-STUDS AND HAND POWERED TOOL FOR IT

[76] Inventor: Andrzej J. Szulc, 1 Meadowglen Place, apt. 601, Scarborough, Ontario, Canada, M1G 2V5

[21] Appl. No.: 987,214

[22] Filed: Dec. 8, 1992

[30] Foreign Application Priority Data

Dec. 23, 1991 [CA] Canada ..... 2058307

[51] Int. Cl.[5] ..... B21D 28/34

[52] U.S. Cl. ..... 72/325; 72/409; 81/367

[58] Field of Search ..... 72/325, 409; 81/367, 81/373, 375, 383; 52/735, DIG. 1, 334

[56] References Cited

U.S. PATENT DOCUMENTS 925,865 6/1909 Brown ..... 52/735
1,044,283 11/1912 Stanger ..... 72/325
1,465,793 8/1923 Schilling ..... 72/325
1,837,451 12/1931 Lee ..... 72/325
3,925,875 12/1975 Doke ..... 72/325
4,571,975 2/1986 Pawloski ..... 72/325

FOREIGN PATENT DOCUMENTS 513815 2/1921 France ..... 72/409
335826 10/1930 United Kingdom ..... 72/325

*Primary Examiner*—Daniel C. Crane

[57] ABSTRACT

A method and hand powered tool for forming openings in metal wall-studs thereby to receive electrical cables, which can be easily pulled through these openings. The tool comprises pyramidally shaped piercer attached to a jaw which is pivotally connected to a handle having affixed hollow die. The piercer, pushed into stud's wall by lever, forms in the stud an opening having guiding tabs shaped from material displaced from the area of said opening.

2 Claims, 1 Drawing Sheet

METHOD OF FORMING CABLE-GUIDING OPENING IN METAL WALL-STUDS AND HAND POWERED TOOL FOR IT

The present invention relates to a method of making openings in sheet metal such as wall-studs and to tools for making openings.

The openings in metal wall-studs have to be made for pulling in (fishing in) electrical cables, during construction or renovation works. Metal wall-studs are manufactured with three round and three rectangular openings, however, these openings become often covered by electrical boxes or by other studs or metal channels (runners) supporting said boxes. These runners have no openings at all.

Presently, for making openings in studs on construction site, a tool called "stud punch" is commonly used. This tool makes round holes similar to holes punched in stud factory. Unfortunately, all the openings have one common, undesirable feature: their edges are sharp like knife. This defect proves that the method of making opening by punching is improper.

The cables pulled through punched openings are usually aluminum-armoured cables. Their armour is made of aluminum ribbon wound on electrical wires. Each coil of said ribbon has arrowhead-like shape. This feature requires the cable to be fished in only in one direction. Despite observing this requirement, pulling armoured cable through many openings is very difficult. Pulling back such a cable is almost impossible. Other kinds of cables, as thermostat cables or burglar-alarm cables are also pulled in through punched holes, and their plastic jacket can be easily damaged by sharp edges.

Presently used stud punch employs typical couple of dies, which have to be perfectly aligned to make clean cuts. The required precision contributes to the tool's weight and price. The small disc of metal, cut out from the stud, has to be picked up from the floor or swept to garbage bin and eventually deposited in garbage dump site.

Another disadvantage of presently used stud punch is that this tool requires a lot of space to engage it. When additional supporting studs are present in close proximity, the punch can not be used, unless the stud is unscrewed and/or twisted, what is not always possible, but always time-consuming. The punching is impossible when two studs are joined "back to back".

All above mentioned difficulties and problems can be avoided or solved by utilizing the present invention shown by FIG. 1.

DESCRIPTION OF THE PREFERRED EMBODIMENT

Figure 1:
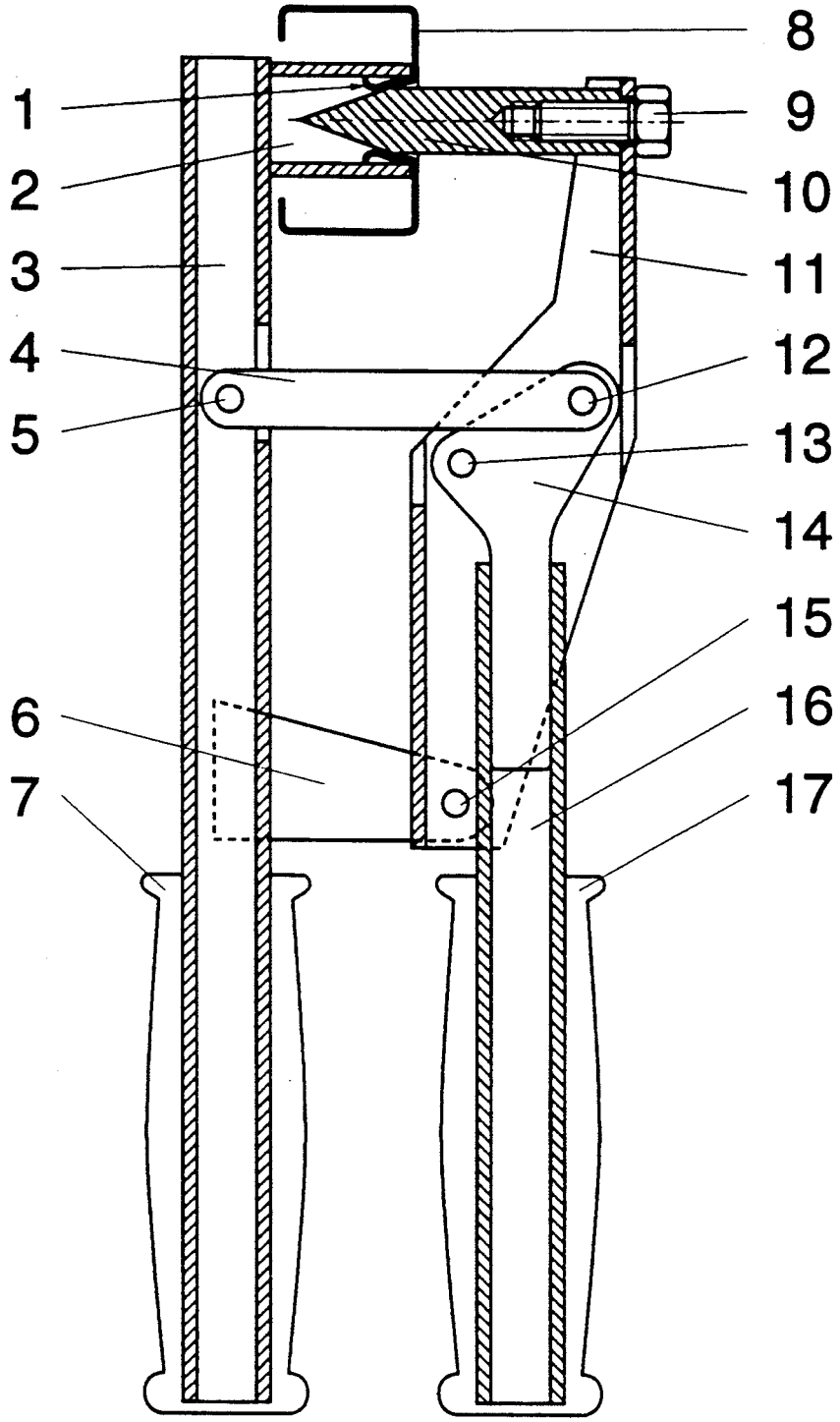
FIG. 1 shows an articulated hand tool of the invention for forming openings in metal wall-studs and forming tabs about the opening.

The recommended method for making opening in metal wall-stud is piercing it with specially shaped piercer 10, having prismatic shank with pyramidally shaped working end. After the sharp tip of pyramid pierces the initial point in the stud 8, the pyramid's edges tear stud's metal, forming it in triangular-like tabs 1. Simultaneously to tearing metal, the pyramid's surfaces bend said tabs, rolling and placing them around formed in this manner opening. Further movement of the piercer presses the tabs' tips against inner walls of hollow die 2. Finally, small part of prismatic shank enters the opening, flattening slightly the rolled tabs, thus completing the forming of the tabs as guides in said opening.

Such formed guides allow the armoured cable to be pulled through several openings with ease; pulling the cable back is also easy, therefore electrical job can be done fast. And there is no damage to plastic-covered cables.

The piercer 10 can be made of steel bar having cross section in shape of hexagon, pentagon or square. The sides of pyramid, made by, for example, milling, should correspond with sides of prism. The more edges pyramid has, the more tearings in material have to be done, thus more force is required to push piercer; therefore, square-based pyramid, milled from square bar is preferrable. Square opening in stud can be easily enlarged by using pliers, if such a rare need occurs. Smaller openings can be made as well, simply by closing tool's handles only halfway.

The hollow die 2 can be made of pipe or hollow structural shape, like square tubing. Its shape is not critical, since its diameter or lateral dimension should be substantially bigger than thickness of cooperating piercer. There is no need to observe exact alignment of the hollow die and the piercer; thanks to this feature, the cost of manufacturing this tool can be low.

According to features of the invention, there is provided a tool of compact shape and lightweight, easy to carry, as shown in FIG. 1.

The hollow die 2 is affixed to handle 3, which is made of square tubing. This handle houses one end of link 4, pivotally connected to said handle by bolt 5. Support 6 is affixed to handle 3, too. The jaw 11 is pivotally connected by bolt 15 to support 6 and can be pushed towards handle 3 or retracted from it by lever 14, which is pivotally connected to jaw 11 by bolt 13. The lever 14 is connected pivotally to link 4 by bolt 12. At its end, the jaw 11 is affixed to the piercer 10 by screw 9. The lever 14 is extended by handle 16. Both handles 3 and 16 are equipped with rubber or plastic handgrips 7 and 17.

The design of this tool allows it to be engaged also on two studs which are joined (screwed) together "back to back". Usually, such two studs have their factory prepunched holes misaligned. The opening can be pierced only through one sheet of metal, therefore factory prepunched hole should be used as a place to pierce adjacent stud. The same design of this tool allows it to pierce any stud in opposite direction, shaping tabs outward of the stud. The opening can be done also on a side wall of any wider stud, particularly if one or more small holes are needed, for example, for tie-wire. The tool can be easily inserted and used between studs located closely to each other, because only the piercer or the hollow die needs to be inserted between such studs. It is possible thanks to grouping all force transmitting elements in zone between piercer-die couple and handgrips.

I claim:

1. A method of forming an opening in a metal wall-stud and forming tabs about the hole as guides for fished-in electrical cables, comprising providing a hand tool having a handle with a hollow die affixed to one end and a handgrip on another end, a jaw with a piercer affixed thereto having pyramidally shaped working end, the piercer cooperating with the hollow die so as to cut and deform tabs in the wall-stud, a support affixed to the handle at a position intermediate the handgrip and hollow die and having means for pivotal connection to said jaw with said support extending above said handle so that the pivotal connection is spaced away from the handle, a lever, extending from a second handle and equipped with a handgrip, means for pivotally connecting said lever to said jaw and a link having one end pivotally connected to the handle and another end pivotally connected to the lever, squeezing the handgrips together to cause the jaw to pivot about the pivotal connection on the support and the piercer and hollow die to cooperate with one another to initially puncture the metal stud in the central area of intended opening with following tearing of the material of said metal stud followed by partially separating the material of the said stud in the area of the opening, and shaping the separated material into circumferentially placed triangular-like tabs.

2. A tool for forming an opening in a metal wall-stud and forming tabs about the hole as guide for fished-in electrical cables, comprising:

a handle with a hollow die affixed to one end and a handgrip on another end;

a jaw with a piercer affixed thereto having pyramidally shaped working end, the piercer cooperating with the hollow die so as to cut and deform tabs in the wall-stud;

a support affixed to the handle at a position intermediate the handgrip and the hollow die and having means for pivotal connection to said jaw with said support extending above said handle so that the pivotal connection is spaced away from the handle;

a lever, extending from a second handle and equipped with a handgrip, and means for pivotally connecting said lever to said jaw;

a link having one end pivotally connected to the handle and another end pivotally connected to the lever, whereby, when the tool's hand grips are squeezed together, the lever forces the piercer into material supported by the hollow die metal wall-stud, thereby resulting in forming an opening.

* * * * *